United States Patent [19]

Swartzbaugh

[11] Patent Number: 4,527,704

[45] Date of Patent: Jul. 9, 1985

[54] TAMPER INDICATING PACKAGE

[75] Inventor: Peter T. Swartzbaugh, Toledo, Ohio

[73] Assignee: Owens-Illinois, Inc., Toledo, Ohio

[21] Appl. No.: 574,107

[22] Filed: Jan. 26, 1984

[51] Int. Cl.[3] ..... B65D 41/32

[52] U.S. Cl. ..... 215/252; 215/253

[58] Field of Search ..... 215/252, 253, 258

[56] References Cited

U.S. PATENT DOCUMENTS

| | | | |
|---|---|---|---|
| 3,455,478 | 7/1969 | Fields et al. | 215/252 |
| 3,929,246 | 12/1975 | Leitz | 215/242 |
| 4,333,577 | 6/1982 | Mumford | 215/252 X |
| 4,394,918 | 7/1983 | Grussen | 215/252 X |
| 4,402,418 | 9/1983 | Ostrowsky | 215/252 |

*Primary Examiner*—Steven M. Pollard

*Attorney, Agent, or Firm*—John R. Nelson

[57] ABSTRACT

A tamper indicating package comprising a container having a body portion and a neck portion having external threads thereon and a plastic closure having a top wall and a peripheral skirt having internal threads adapted to engage the threads on the neck of the container. A tamper indicating band extends downwardly from said skirt and is connected by a plurality of integral bridge portions to the skirt of the closure. The annular bead on the container and the radial bead on the tamper indicating band have interengaging portions which are operable during unthreading of the closure to shear the bridge portions. Some of the bridge portions are shaped to readily withstand the forces encountered in applying the closure and other of the bridge portions are shaped to be readily severed in removing the closure.

14 Claims, 8 Drawing Figures

TAMPER INDICATING PACKAGE

This invention relates to tamper indicating packages.

BACKGROUND AND SUMMARY OF THE INVENTION

In the packaging of the various products, it has become common to provide some indication with whether or not the closure has been removed and possibly the contents have been tampered with. Thus, in one type of tamper indicating package that has been used, wherein a closure is threaded on the neck of the container, the skirt of the closure is formed with an integral tamper indicating band connected along a weakened line and the band has a radially inwardly extending bead that snaps over an annular bead on the container. When the closure is unthreaded, the tamper indicating band is severed from the closure along the weakened line to indicate that the closure has been removed and reapplied.

One of the problems with respect to such a closure, is that the force necessary to apply the closure and snap the tamper indicating band portion of the closure over the annular bead of the container is such that the weakened line may be broken during application of the closure.

In order to overcome this problem, it has been proposed to utilize a plurality of circumferentially spaced bridge portions which also interconnect the skirt of the closure and the tamper indicating band. When the closure is applied, the bridge portions absorb the axial force and prevent tearing of the band from the closure. When the threaded closure is unthreaded to remove the closure, the bridge portions are subjected to an axial tension in order to sever them as well as the remaining weakened line and leave the tamper indicating band on the container. Such a construction requires a careful control of the dimensions of the bridge in order to keep the force required to remove the closure to a reasonable value. On the other hand, if the bridge portions and the weakened line are made so thin that they are easily fractured, it is possible for a child to readily remove the closure.

Among the objectives of the present invention are to provide a tamper indicating package that includes strong bridge portions which will permit the application of the closure without damage to the connection of the tamper indicating band to the remainder of the closure; which has bridge portions that can be readily severed during removal of the closure; which will deter the ready removal of the closure by children; wherein the closure can be easily made by molding; and wherein a better quality of closure is made possible.

In accordance with the invention, the tamper indicating package comprises a container having a body portion and a neck portion having external threads thereon, the closure has a top wall and a peripheral skirt having internal threads adapted to engage the threads on the neck of the container. A tamper indicating band extends downwardly from the skirt and is connected to the closure by a plurality of integral bridge portions. The annular bead on the container and the radial bead on the tamper indicating band have interengaging means which are operable during unthreading of the closure to shear the bridge portions. Some of the bridge portions are shaped to readily withstand the forces encountered in applying the closure and other of the bridge portions are shaped to be readily severed in removing the closure.

DESCRIPTION

Figure 2:
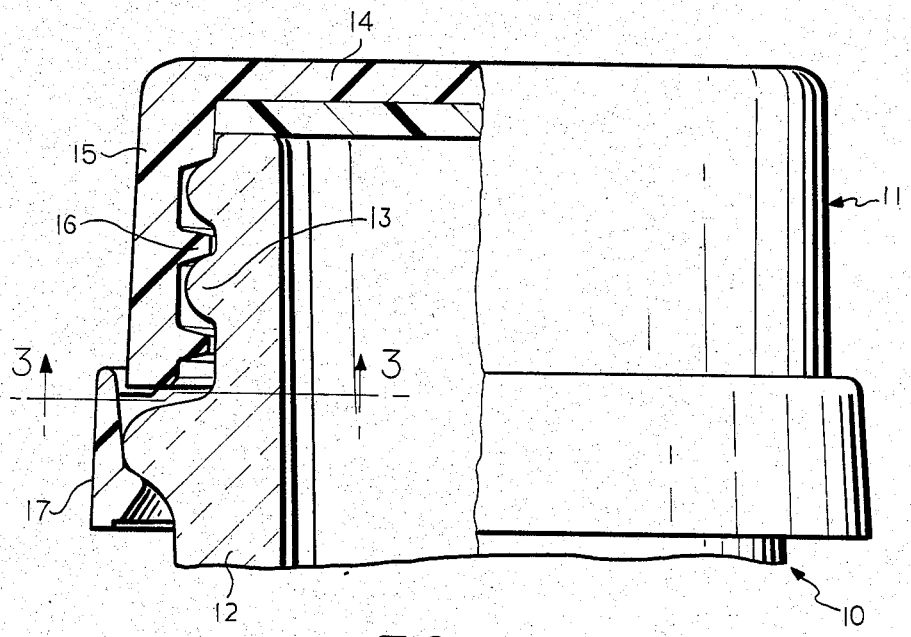
FIG. 2 is a vertical sectional view of the package taken along the line 2—2 in FIG. 1.
Figure 1:
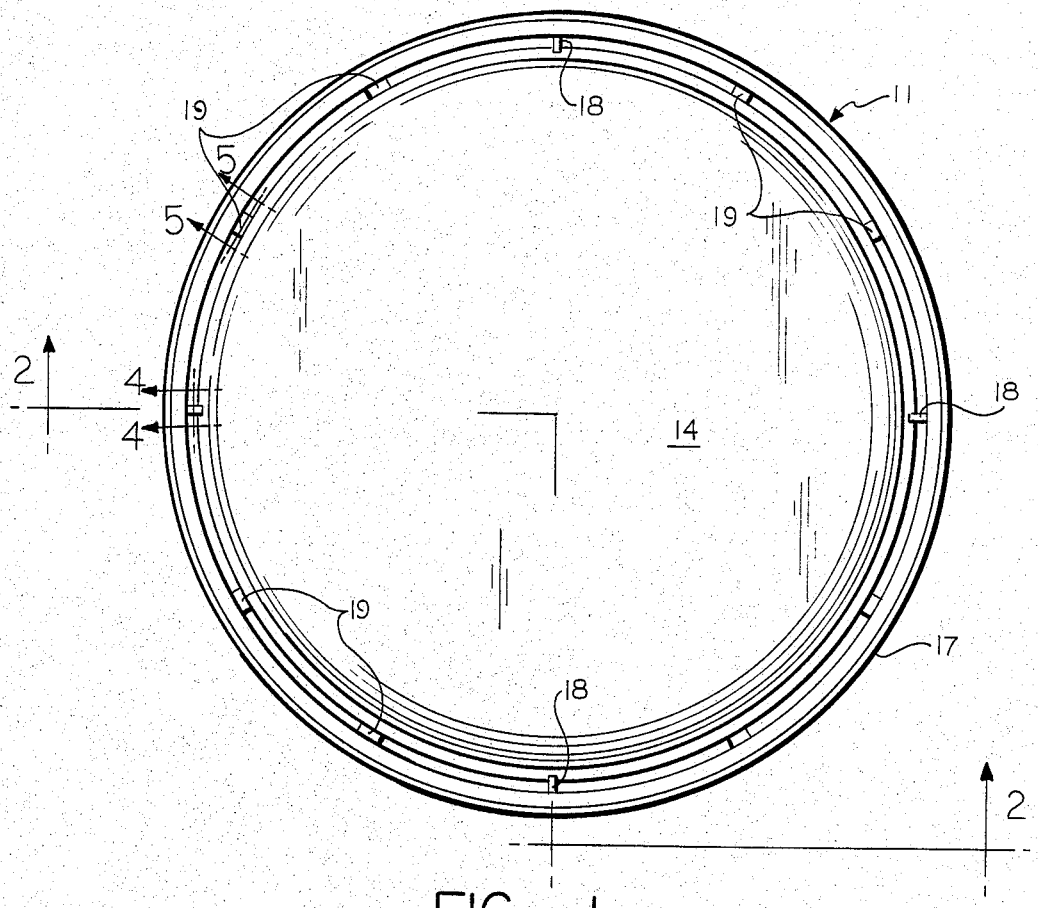
FIG. 1 is a top plan view of a tamper indicating package embodying the invention.

Referring to FIGS. 1 and 2, the tamper indicating package embodying the invention comprises a container 10 and closure 11. The container 10 may be made of glass or plastic such as propylene. The closure 11 is made of plastic such as propylene. The container 10 includes a body portion and a neck 12 having external threads 13 thereon. The closure 11 includes a top wall 14 and peripheral skirt 15 having internal threads 16 adapted to engage the threads 13 on the neck 12 of the container 10.

Figure 3:
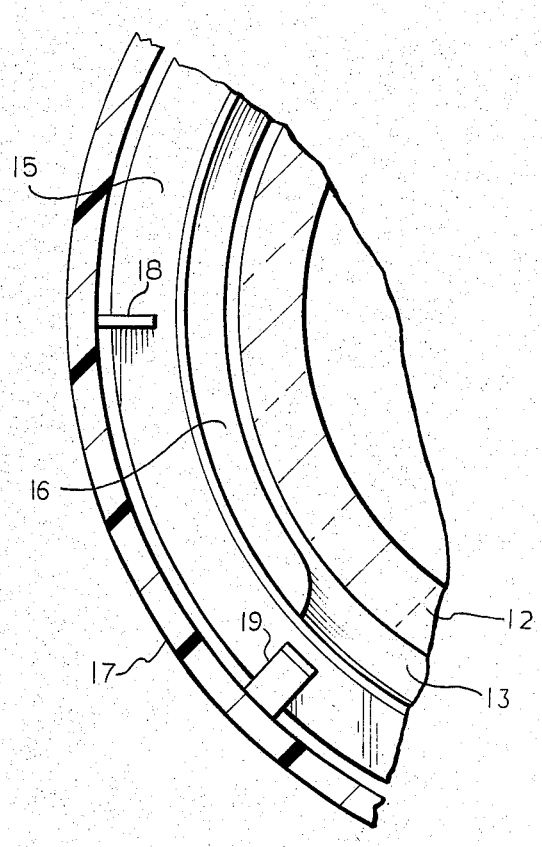
FIG. 3 is a fragmentary sectional view on an enlarged scale taken along the line 3—3 in FIG. 2.
Figure 4:
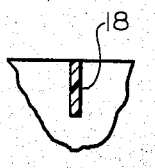
FIG. 4 is a fragmentary sectional view taken along the line 4—4 in FIG. 1.
Figure 5:
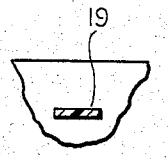
FIG. 5 is a fragmentary sectional view taken along the line 5—5 in FIG. 1.

In accordance with the invention, a tamper indicating band 17 having a greater diameter than skirt 15 is made integral with the skirt 15 of the closure 11 and is connected thereto by a plurality of bridge portions 18, 19. Each bridge portion 18 extends radially from the skirt 15 to the upper end of band 17 and has a cross section with greater axial dimension than a circumferential dimension, that is, the bridge portion 18 extends vertically as viewed in FIG. 4. Each bridge portion 19 extends radially from the skirt 15 to the upper end of band 17 and has a cross section with a greater circumferential dimension than an axial dimension such that the bridge portion 19 extends horizontally as viewed in FIG. 5. A portion of each bridge portion 18, 19 extends below the skirt 15 as shown in FIG. 3.

The container 10 is formed with an annular bead 20. The tamper indicating band 17 is formed with a radially inwardly extending bead 21.

When the closure 11 is threaded on the container 10, the radial bead 24 on the tamper indicating band 17 snaps over and engages the annular bead 20 on the container 10. When the closure 11 is unthreaded, bead 21 prevents removal of band 17 and a shear force is applied to sever the bridge portion 18, 19 leaving the band on the container.

The nature of the force applied permits the bridge portions 18, 19 to be made larger than normal. This not only provides a strong force to prevent breaking of the bridge portions 18 during threading of the closure onto the container, but in addition, makes the closure easier to manufacture, since the plastic will flow more easily in the larger cross section of the bridges. On the other hand, the shear force is sufficient to deter children. The control of small dimensions on the bridges is obviated and therefore an overall better quality closure can be produced.

Figure 6:
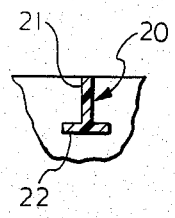
FIG. 6 is a view similar to FIGS. 4 and 5 of a modified form of bridge portion.

In the form shown in FIG. 6, the bridge portion 20 combines the vertical and horizontal bridge portions 18, 19 in the same bridge portions and has an inverted T-shaped cross section. The bridge portion 20 includes a vertical portion 21 and a horizontal portion 22.

Figure 7:
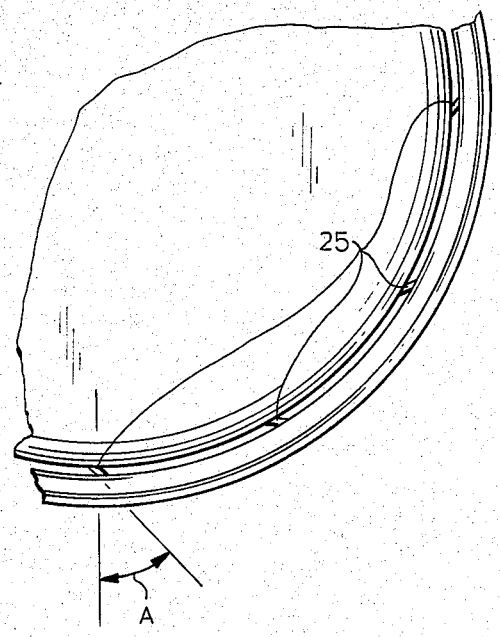
FIG. 7 is a fragmentary sectional view similar to FIG. 2 showing a modified form of bridge portions.
Figure 8:
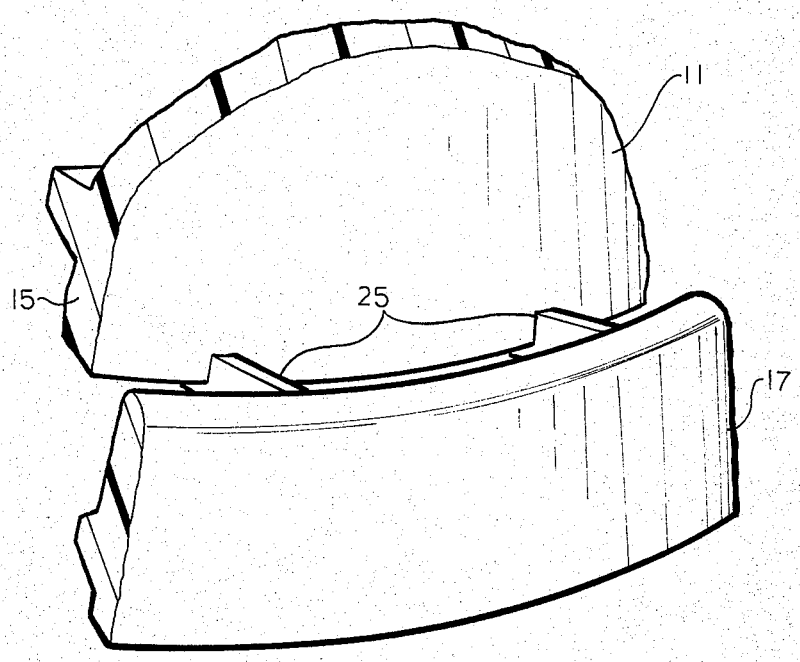
FIG. 8 is a fragmentary perspective view of a portion of the closure shown in FIG. 7.

In the form shown in FIGS. 7 and 8, the bridge portions 25 comprise generally rectangular webs which extend at an angle A to a radial plane through each bridge portion 25. The radially outer end of each bridge portion 25 trails the radially inner or leading end with respect to the thread of the closure, herein shown as a right hand thread. When the closure is applied, the orientation of the bridge portions 25 permits the bridge portions 25 to flex while reducing the tendency to shear. When the closure is rotated in the opposite direction to remove it, the orientation of the bridge portions 25 will increase the shear effect facilitating the breaking of the bridge portions.

The angle shown which each bridge portion 25 makes with a radial plane through the bridge portion preferably comprises about 45° although the angle may be varied in order to provide the proper balance between flexing on application and shearing upon removal.

In addition, it is possible to combine the various bridge portions shown in FIGS. 1–5 with bridge portions shown in FIGS. 7 and 8 forming an angle with the radial plane in a symmetrical array in order to obtain the benefits of each of the types of bridge portions.

I claim:

1. A tamper indicating package comprising a container having a body portion and a neck portion, said neck portion having external threads thereon, said container having an annular bead spaced below the threads on the neck, a closure having a top wall and a peripheral skirt, said skirt having internal threads adapted to engage the threads on the neck of the container, a tamper indicating band extending downwardly from said skirt, a plurality of circumferentially spaced integral bridges including integral bridge portions interconnecting said skirt and said band, said band having a bead extending radially inwardly adapted to engage the annular bead on the container when the closure is threaded on the container, each of said bridge portions having a cross section such that the bridge portions have a greater width than thickness, at least some of said bridge portions having a cross section in a circumferential direction with respect to said band and said closure which has a greater axial dimension with respect to said band and said closure than a circumferential dimension with respect to said band and said closure and others of said bridge portions having a cross section in a circumferential direction with respect to said band and said closure which has a greater circumferential dimension with respect to said band and said closure than an axial dimension with respect to said band and said closure such that at least some of the bridge portions will withstand the forces when the closure is applied to the containers and the bridge portions will be readily severed during removal of the closure.

2. The tamper indicating package set forth in claim 1 wherein some of said bridge portions extend axially with respect to said band and said closure and the others of said bridge portions extend circumferentially with respect to said band and said closure.

3. The tamper indicating package set forth in claim 1 wherein said bridge portions comprise a part of a single bridge portion.

4. The tamper indicating package set forth in claim 3 wherein said single portion includes an axially extending portion and a circumferentially extending portion.

5. The tamper indicating package set forth in claim 1 wherein a portion of at least some of said bridge portions extend beneath the lower edge of the skirt.

6. A tamper indicating package as set forth in claim 1 wherein said closure includes at least some bridge portions having their greater dimension extending radially outwardly and extending at an angle to a radial plane through each portion, the radially outer end of said bridge portion trailing the radially inner end of each bridge portion with respect to the direction of the thread of the closure.

7. A tamper indicating closure for a container having a body portion and a neck portion having external threads thereon, said closure comprising a top wall and a peripheral skirt, said skirt having internal threads adapted to engage the threads on the neck of the container, a tamper indicating band extending downwardly from said skirt, a plurality of integral circumferentially spaced integral bridges including integral bridge portions interconnecting said band to said skirt, said container having an annular bead spaced below the threads on the neck, said band having a radially inwardly extending bead adapted to engage the annular bead on the container when the closure is threaded on the container, each of said bridge portions having a cross section such that the bridge portions have a greater width than thickness, at least some of said bridge portions having a cross section in a circumferential direction with respect to said band and said closure which has a greater axial dimension with respect to said band and said closure than a circumferential dimension with respect to said band and said closure and others of said bridge portions having a cross section in a circumferential direction with respect to said band and said closure which has a greater circumferential dimension with respect to said band and said closure than an axial dimension with respect to said band and said closure such that at least some of the bridge portions will withstand the forces when the closure is applied to the containers and the bridge portions will be readily severed during removal of the closure.

8. The tamper indicating closure set forth in claim 7 wherein some of said bridge portions extend axially with respect to said band and said closure and the others of said bridge portions extend circumferentially with respect to said band and said closure.

9. The tamper indicating closure set forth in claim 7 wherein said bridge portions comprise a part of a single bridge portion.

10. The tamper indicating closure set forth in claim 9 wherein said single portion includes an axially extending portion and a circumferentially extending portion.

11. The tamper indicating closure set forth in claim 7 wherein a portion of at least some of said bridge portions extends beneath the lower edge of the skirt.

12. The tamper indicating closure set forth in claim 7 wherein said closure includes at least some bridge portions having their greater dimension extending radially outwardly and extending at an angle to a radial plane through each portion, the radially outer end of each bridge portion trailing the radially inner end of each bridge portion with respect to the direction of the thread of the closure.

13. A tamper indicating package comprising a container having a body portion and a neck portion, said neck portion having external threads thereon, said container having an annular bead spaced below the threads on the neck, a closure having a top wall and a peripheral skirt, said skirt having internal threads adapted to engage the threads on the neck of the container, a tamper indicating band extending downwardly from said skirt, a plurality of circumferentially spaced integral bridges including integral bridge portions interconnecting said skirt and said band, said band having a bead extending radially inwardly adapted to engage the annular bead on the container when the closure is threaded on the container, each of said bridge portions having a cross section such that the bridge portions have a greater width than thickness, wherein said closure includes bridge portions having their greater dimension extending radially outwardly and extending at an angle to a radial plane through each portion, the radially outer end of each bridge portion trailing the radially inner end of each bridge portion with respect to the direction of the thread of the closure.

14. A tamper indicating closure for a container having a body portion and a neck portion having external threads thereon, said closure comprising a top wall and a peripheral skirt, said skirt having internal threads adapted to engage the threads on the neck of the container, a tamper indicating band extending downwardly from said skirt, a plurality of integral circumferentially spaced integral bridges including integral bridge portions interconnecting said band to said skirt, said container having an annular bead spaced below the threads on the neck, said band having a radially inwardly extending bead adapted to engage the annular bead on the container when the closure is threaded on the container, each of said bridge portions having a cross section such that the bridge portions have a greater width than thickness, wherein said closure includes bridge portions having their greater dimension extending radially outwardly and extending at an angle to a radial plane through each portion, the radially outer end of each bridge portion trailing the radially inner end of each bridge portion with respect to the direction of the thread of the closure.

* * * * *